US007644707B2

(12) United States Patent
Kraus et al.

(10) Patent No.: US 7,644,707 B2
(45) Date of Patent: Jan. 12, 2010

(54) IGNITION DEVICE FOR AN INTERNAL COMBUSTION ENGINE

(75) Inventors: Markus Kraus, Wiesing (AT); Arno Gschirr, Innsbruck (AT); Markus Kröll, Ginzling (AT)

(73) Assignee: GE Jenbacher GmbH & Co OHG, Jenbach (AT)

( * ) Notice: Subject to any disclaimer, the term of this patent is extended or adjusted under 35 U.S.C. 154(b) by 41 days.

(21) Appl. No.: 11/790,209

(22) Filed: Apr. 24, 2007

(65) Prior Publication Data

US 2008/0011281 A1 Jan. 17, 2008

(30) Foreign Application Priority Data

May 12, 2006 (AT) ..... A 819/2006

(51) Int. Cl.
*F02P 3/05* (2006.01)

(52) U.S. Cl. ..... 123/623; 123/644; 123/656

(58) Field of Classification Search ..... 123/623, 123/644, 656

See application file for complete search history.

(56) References Cited

U.S. PATENT DOCUMENTS

| | | | | |
|---|---|---|---|---|
| 3,831,571 | A * | 8/1974 | Weber | 123/610 |
| 4,008,698 | A * | 2/1977 | Gartner | 123/611 |
| 4,246,881 | A * | 1/1981 | Bodig | 123/644 |
| 4,365,609 | A | 12/1982 | Toyama et al. | |
| 4,402,299 | A * | 9/1983 | Nakao et al. | 123/632 |
| 5,060,623 | A * | 10/1991 | McCoy | 123/605 |
| 5,208,540 | A | 5/1993 | Hoeflich | |
| 5,690,085 | A * | 11/1997 | Kawamoto | 123/644 |
| 5,775,310 | A * | 7/1998 | Ito et al. | 123/644 |
| 6,186,130 | B1 * | 2/2001 | Skinner et al. | 123/625 |
| 6,283,104 | B1 * | 9/2001 | Ito et al. | 123/644 |
| 6,796,297 | B2 * | 9/2004 | Schmied et al. | 123/609 |
| 6,877,495 | B2 * | 4/2005 | Morrissette et al. | 123/609 |
| 2002/0121272 | A1 | 9/2002 | Kraus | |

FOREIGN PATENT DOCUMENTS

| | | |
|---|---|---|
| DE | 11 73 288 B | 7/1964 |
| DE | 43 03 030 A1 | 2/1993 |
| DE | 43 03 030 | 9/1993 |
| DE | 100 34 725 A1 | 7/2000 |
| EP | 1 199 470 A2 | 4/2002 |
| GB | 2 143 381 | 2/1985 |

(Continued)

OTHER PUBLICATIONS

European Search Report issued Apr. 15, 2008 in EP Application No. 07006780.

(Continued)

*Primary Examiner*—Erick Solis
(74) *Attorney, Agent, or Firm*—Wenderoth, Lind & Ponack, L.L.P.

(57) ABSTRACT

An Ignition device for an internal combustion engine including a control device and an ignition coil which is feedable on its primary side by a voltage supply unit. The control device is provided to interrupt or reduce the voltage impressed on the primary side of the ignition coil when a magnitude of a magnetic induction B on the primary side of the ignition coil is greater than a predeterminable maximum value.

37 Claims, 3 Drawing Sheets

FOREIGN PATENT DOCUMENTS

| | | | |
|---|---|---|---|
| JP | 4-295180 | | 10/1992 |
| JP | 5-231280 | * | 9/1993 |
| JP | 2002-21698 | | 1/2002 |
| WO | 90/13742 | | 11/1990 |

OTHER PUBLICATIONS

Anonymous, "Capacitor discharge ignition system having extended burn time", Research Disclosure, Mason Publications, Jan. 1992, XP007117219, ISSN: 0374-4353.

* cited by examiner

IGNITION DEVICE FOR AN INTERNAL COMBUSTION ENGINE

BACKGROUND OF THE INVENTION

The present invention relates to an ignition device for an internal combustion engine, in particular for a gas engine, having a control device and an ignition coil, which is feedable on its primary side by a voltage source.

The ignition coils of the ignition devices according to the preamble are transformers, on the secondary side of which the high voltage is applied to the ignition plug. During operation of these ignition coils power is transferred from the primary side to the secondary side.

SUMMARY OF THE INVENTION

The object of the invention is to design this as effectively as possible and to prevent a destruction or impairment of the components of the ignition device even when there are high power requirements.

This is achieved according to the invention by the control device being provided to interrupt or reduce the voltage applied to the primary side of the ignition coil when a magnitude of a magnetic induction B on the primary side of the ignition coil exceeds a predeterminable maximum value.

Thanks to this measure according to the invention of limiting the magnitude of the magnetic induction on the primary side on the one hand too-high currents which could lead to an impairment or destruction of the primary-side components of the ignition device are prevented from flowing on the primary side. On the other hand however, this type of limiting ensures an effective power transfer via the ignition coil, since, well below the saturation of the ignition coil, relatively small changes in the primary-side current cause relatively large changes in the magnitude of the magnetic induction B.

It is preferably provided that the predeterminable maximum value of the magnitude of the magnetic induction B is an upper limit of an operating range in which there is an at least approximately linear relationship between the magnitude of the magnetic induction B and the primary-side current. Advantageous embodiments provide for an indirect determination or assessment of the magnetic induction B on the primary side of the ignition coil. A first variant is characterized in that the control device determines the magnitude of the magnetic induction B on the primary side of the ignition coil indirectly via an assessment of a duration of activated time(s) and de-activated time(s), wherein during the activated time(s) the voltage of the voltage source is applied to the primary side of the ignition coil and during the de-activated time(s) the voltage of the voltage source is not applied to the primary side of the ignition coil.

Another variant provides that the ignition device has a primary current measuring device and the control device determines the magnitude of the magnetic induction B on the primary side of the ignition coil indirectly via an assessment of the magnitude of the primary-side current.

BRIEF DESCRIPTION OF THE DRAWINGS

Further features and details of the present invention will become apparent from the following description of the figures, of which.

DETAILED DESCRIPTION OF THE INVENTION

The regulating principle described below can be used for controlling a modulated high-voltage capacitor ignition (HCl). The modulated HCl is based on the idea of feeding the ignition energy of the capacitor to the ignition coil progressively. In principle this can occur in a controlled or regulated manner. The regulated variant is realized according to the present invention and described in the following. In the regulated version the primary side of the ignition coil is switched to the supply voltage according to the state of the ignition spark on the secondary side. An advantage of this system lies in the temporal lengthening of the ignition spark when there is simultaneous control of the ignition spark characteristic. Combustion times, preferably up to 5 000 microseconds, can be achieved without problems with this system. In particular in the case of gas engines a high-voltage supply of up to 40 kV (kilovolts) is often required. In the case of energizing of a system according to the invention this can be achieved in less than 100 microseconds. The combustion time is preset typically at between 100 and 1 200 microseconds by the control device.

Figure 2:
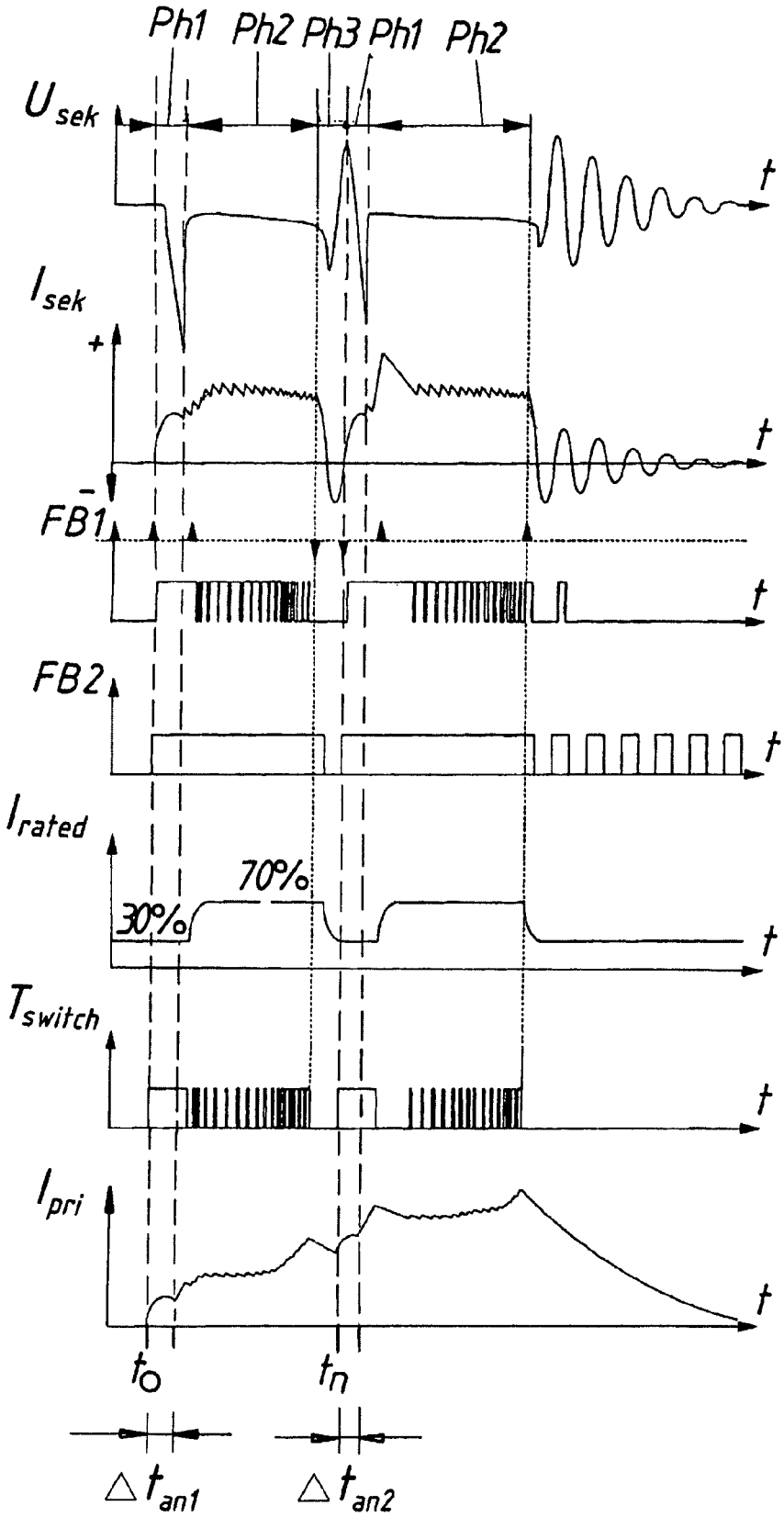
FIG. 2 shows the course of various parameters to represent an ignition process.

During this time the ignition spark is characterized by an adjustable preset of the combustion current target value $I_{rated}$ (see FIG. 2). The control device must control the primary-side voltage supply of the ignition coil in such a way that the preset characteristic of the ignition spark or the set course of the secondary-side current $I_{rated}$ is achieved as well as possible.

Combustion concepts or internal combustion engines with a high degree of efficiency also display very high turbulences in the combustion chamber. The ignition spark of a spark plug controlled on the secondary side by an ignition device is spatially lengthened by these turbulences and premature extinguishing can occur. In order to prevent a combustion misfire in the combustion chamber due to an insufficient combustion time, the ignition spark must be restored in as short a time as possible. The necessary ignition voltage can be very close to the high-voltage supply of the ignition coil. In order to create another ignition spark as quickly as possible it should be taken into account that, when the ignition spark goes out, there is still residual energy in the oscillating circuit of the high-voltage circuit, i.e. on the secondary side of the ignition coil. In order to restore the ignition spark, a time must therefore be chosen which uses positively the existing energy in the system. This is achieved in that subsequent to an interruption of the primary-side voltage and/or current supply of the ignition coil during an ignition process or subsequent to the drop of the primary-side voltage and/or of the primary-side current $I_{pri}$ through the ignition coil 3 below a predeterminable threshold value during the ignition process, the control device 12 re-activates the primary-side voltage and/or current supply of the ignition coil 3 or adjusts it/them above the threshold value only when the secondary-side current $I_{sek}$ induced thereby acts in the direction of the preferably immediately, previously determined course of the secondary-side current $I_{sek}$.

Figure 1:
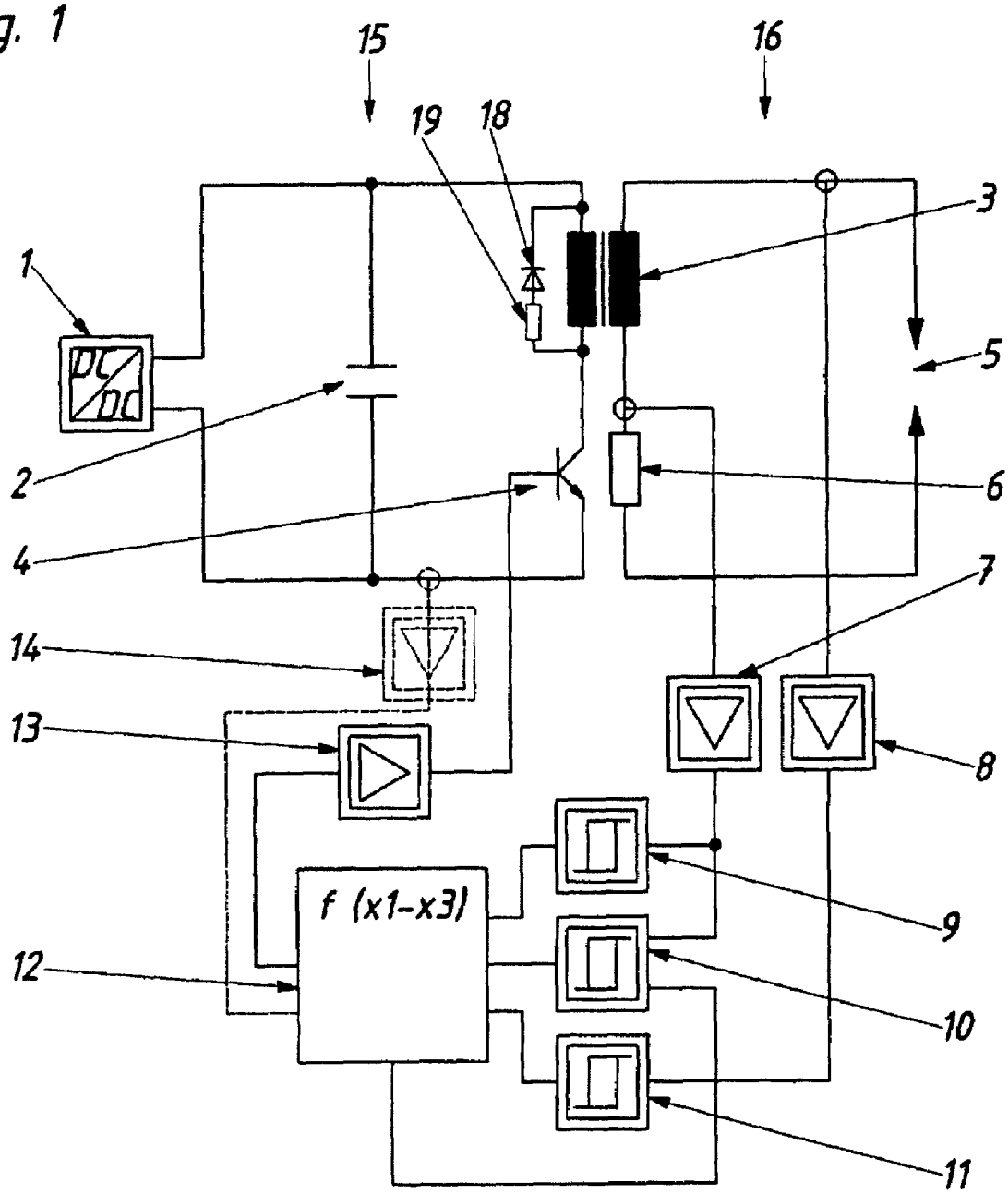
FIG. 1 is a schematic circuit diagram of an embodiment example according to the invention of an ignition device.

FIG. 1 schematically shows a regulation principle for an ignition device modulated according to the invention, here in the form of a high-voltage capacitor ignition. The ignition coil 3 is a generally known transformer, on the primary side 15 of which a voltage supply is provided and on the secondary side 16 of which the spark plug 5 is supplied with high voltage in order to produce an ignition spark. In the present embodiment example on the primary side this is a direct current voltage source which consists here of the DC-DC converter 1 and a capacitor 2 connected in parallel thereto. In addition, the switch 4 operated by the control device 12 via the control 13 is provided on the primary side. This can be formed as a semiconductor switch. The switch 4 has at least one first switching state in which the voltage of the voltage source is applied at the ignition coil 3, and at least a second switching state, in which the voltage of the voltage source is not applied at the ignition coil 3. In addition, a recovery diode 18 is connected in parallel to the primary-side winding of the ignition coil 3. This serves the de-energizing described below of the primary side 15 in the de-activated state of the voltage source when switch 4 is open. Thanks to the use of the recovery diode 18 maximum energy is kept in the primary-side circuit during the de-energizing. It is optionally possible however to also connect an additional ohmic resistance 19 in series to the recovery diode 18. This admittedly means an energy loss. However, due to the resistance 19 and the thus-achieved damping of the primary side 15 during the de-energizing, on the other hand a faster re-activation after extinguishing of an ignition spark is possible.

The activation and de-activation of the voltage source 1, 2 therefore takes place in this embodiment example exclusively via the switch 4. A primary current measuring device 14 provided in the preferred embodiment example, which serves to measure the current $I_{pri}$ flowing in the primary circuit, is shown by a broken line on the primary side 15. This value $I_{pri}$ is relayed to the control device 12. In addition it is optionally possible to provide another voltage measuring device, instead and/or additionally on the primary side. However this is not shown here explicitly. If it is present then it likewise relays the voltage value measured on the primary side of the ignition coil 3 to the control device 12.

On the secondary side 16 a shunt 6 for the current in the ignition spark is series-connected with the corresponding winding of the ignition coil 3. In addition, a secondary current measuring device 7 as well as a secondary voltage measuring device 8 is provided. The secondary-side current $I_{sek}$ measured by means of the secondary current measuring device 7 is assessed in this embodiment example by means of the polarity evaluation device 9 with regard to its polarity and by means of the current intensity evaluation device 10 with regard to its amplitude or current intensity. It is provided in the embodiment example shown that the evaluation of the magnitude, i.e. of the current intensity of the secondary-side current $I_{sek}$, is limited to whether or not it is greater than or equal to a predeterminable minimum value. This is explained in further detail below with the help of FIG. 2. The combustion current target value $I_{rated}$ is generally used as the predeterminable minimum value.

The values determined by the polarity evaluation device 9 and the current intensity evaluation device 10 do not in any case reproduce individual values but rather the course of the secondary-side current $I_{sek}$ and this is relayed to the control device 12. The same can also apply to the secondary-side voltage $U_{sek}$ measured by means of the secondary-voltage measuring device 8. This is evaluated with the high-voltage evaluation device 11, wherein the latter in turn relays the voltage information to the control device 12. Depending on the stated input parameters, the control device 12 controls the primary-side switch 4 and thus controls the current and voltage supply to the primary side 15 of the ignition coil 3.

FIG. 2 shows, with the help of various parameters, a course of an ignition process during which the ignition spark burns away and is restored. The mode of operation of the control device is then explained in more detail in the following with the help of the individual phases of this ignition process. The regulation passes through the phases ionization Ph1, current regulation Ph2, de-energizing Ph3 and synchronization. The latter is carried out at the point of transition between Ph3 and the following Ph1. $U_{sek}$ shows the secondary-side voltage course. $I_{sek}$ shows the course of the measured secondary-side current. $I_{rated}$ shows the target value course of the secondary-side current and thus preferably also the course of the minimum value with the help of which the current intensity evaluation device 10 decides whether the measured secondary-side current $I_{sek}$ reaches the set current value or exceeds it or lies below it. FB1 shows the evaluation result of the current intensity evaluation device 10. FB1 assumes the value 1 if $I_{sek}$ is greater than or equal to $I_{rated}$. Otherwise FB1 assumes the value 0. FB2 shows the result of the polarity evaluation device 9. If the measured secondary-side current $I_{sek}$ is in the positive range, then FB2 assumes the value 1. If the secondary-side current is negative then FB2 assumes the value 0. $T_{switch}$ shows the course of the control signal of the control device 12 at the switch 4. If this is 1 then the switch 4 is closed and the voltage or current supply is applied at the primary side of the ignition coil 3. If the control signal is equal to 0 then the switch 4 is open, whereby the voltage and current supply is separated from the primary side 15 of the ignition coil 3. The graph $I_{pri}$ shows the course of the primary-side current during the ignition process. All the graphs thus represent the course over time of the parameters.

The current target value of the secondary-side current $I_{rated}$ can be set via the control device 12 and is fed to the current intensity evaluation device 10 in this embodiment example in order to determine FB1. For this purpose the current intensity evaluation device 10 can be formed as a comparator. The target value course of the secondary-side current $I_{rated}$ can be set to different values by the control device 12 preferably both as regards the combustion time and as regards the current intensity. It is also optionally possible to measure the voltage at the spark plug and to include this signal in the regulation.

At the beginning of the ignition process at ignition time $t_0$ the control device 12 is initially switched to the ionization phase Ph1. This is an activation time interval $\Delta t_{an1}$ during which the high voltage is built up which is required to produce the ignition spark. Throughout the activation time interval $\Delta t_{an1}$ it is preferably provided that when switch 4 is closed on the primary side 15 of the ignition coil 3 the voltage of the voltage source 1,2 is applied in full and permanently for at least the predeterminable time interval $\Delta t_{an1}$. The ignition coil 3 is thus connected on the primary side to the supply voltage throughout the ionization phase or on the primary side during the entire activation time interval. In the simplest case the ionization phase is connected for a fixed set time which is necessary for generating the high voltage and thus the secondary-side ignition spark. In order to prevent damage to the system caused by high voltages, the ionization phase can optionally be de-activated even when the high voltage generated by the ignition coil is exceeded compared with a limit value. For this purpose it is provided that during the activation interval $\Delta t_{an1}$, $\Delta t_{an2}$ the control device 12 monitors the secondary-side current $I_{sek}$ via the secondary current measuring device 7 and/or the voltage $U_{sek}$ delivered on the secondary side by the ignition coil 3 via the secondary voltage measuring device 8 and interrupts the primary-side voltage supply of the ignition coil 3 when the secondary-side current $I_{sek}$ and/or the voltage $U_{sek}$ delivered on the secondary side by the ignition coil exceeds (a) predeterminable limit value(s). This option protects the system from being destroyed in the case of a faulty spark plug, a missing spark-plug connector or other malfunction. In the embodiment example shown it is thus provided that during the ionization phase Ph1 or the activation time interval $\Delta t_{an1}$ no regulation according to the secondary-side current is undertaken. With this variant, this begins only upon completion of the ionization phase Ph1 and entry into the current regulation phase Ph2. In this phase Ph2 the secondary-side current $I_{sek}$ (in the ignition spark) is compared with the course of the target value $I_{rated}$ by means of the comparator of the current intensity evaluation device 10. As already described, this comparison produces the signal FB1. If the latter assumes the value 1 and the actual value of the secondary-side current $I_{sek}$ is thus higher than or equal to the target value $I_{rated}$ the energy feed is interrupted on the primary side 15 of the ignition coil 3 by opening the switch 4. In the reverse case the ignition coil 3 is connected to the voltage supply 1,2. With this regulation the current in the ignition spark can be set and in the ideal case the phase Ph2 of the combustion current regulation can be maintained until the end of the set combustion time.

However, in practice the spark is spatially lengthened by the turbulences in the combustion chamber whereby the voltage at the spark plug rises and the spark plug must be fed with more energy. In this case the current target value $I_{rated}$ can no longer be achieved and the ignition spark must be intentionally made to extinguish by initiating the phase of de-energizing Ph3. The requirements of the internal combustion engine can be particularly well satisfied if the pre-set combustion current $I_{rated}$ during the ignition spark time can be changed.

The de-energizing phase Ph3 is needed in two cases. This can be the case firstly, if during the provided ignition process the ignition spark unintentionally burns out and must be restored. Secondly a de-energizing can be needed if the magnetism level or the magnetic induction B on the primary side 15 of the ignition coil 12 becomes too great. In order to illustrate the latter event, reference is made to FIG. 3. This shows the relationship between the current intensity of the primary-side current $I_{pri}$ and the magnitude of the magnetic induction B on the primary side 15 of the ignition coil 3. It can be seen here that—as is generally known—the magnitude of the magnetic induction B enters the saturation range as current $I_{pri}$ increases. In this range very large changes in the current intensity $I_{pri}$ must be undertaken in order to effect comparatively small changes in the magnetic induction B. This is not desirable in ignition systems with an ignition coil 3. In order to prevent this, it is provided that the control device 12 interrupts or reduces the voltage applied at the primary side 15 of the ignition coil 12 if the magnitude of the magnetic induction B on the primary side 15 of the ignition coil 12 exceeds a predeterminable maximum value $B_{max}$. It is advantageously provided that the predeterminable maximum value $B_{max}$ of the magnitude of the magnetic induction B is the upper limit of an operating range 17 in which there is an at least approximately linear relationship between the magnitude of the magnetic induction B and the primary-side current $I_{pri}$. The predeterminable maximum value $B_{max}$ is advantageously well below the saturated range of the ignition coil 3. For comparison two changes in current $\Delta I_1$ and $\Delta I_2$ of the primary-side current are drawn in FIG. 3, which are required in order to produce the same change in the magnitude of the magnetic induction B (magnitude of $\Delta B_1$ equals the magnitude of $\Delta B_2$). Within the operating range 17, due to the more or less linear relationship between primary current $I_{pri}$ and the magnitude of the magnetic induction B, the comparatively small change in current $\Delta I_1$ is sufficient. Above the operating range 17 a much larger change in current $\Delta I_2$ must be applied in order to produce the same change in the magnitude of the magnetic induction B.

Figure 3:
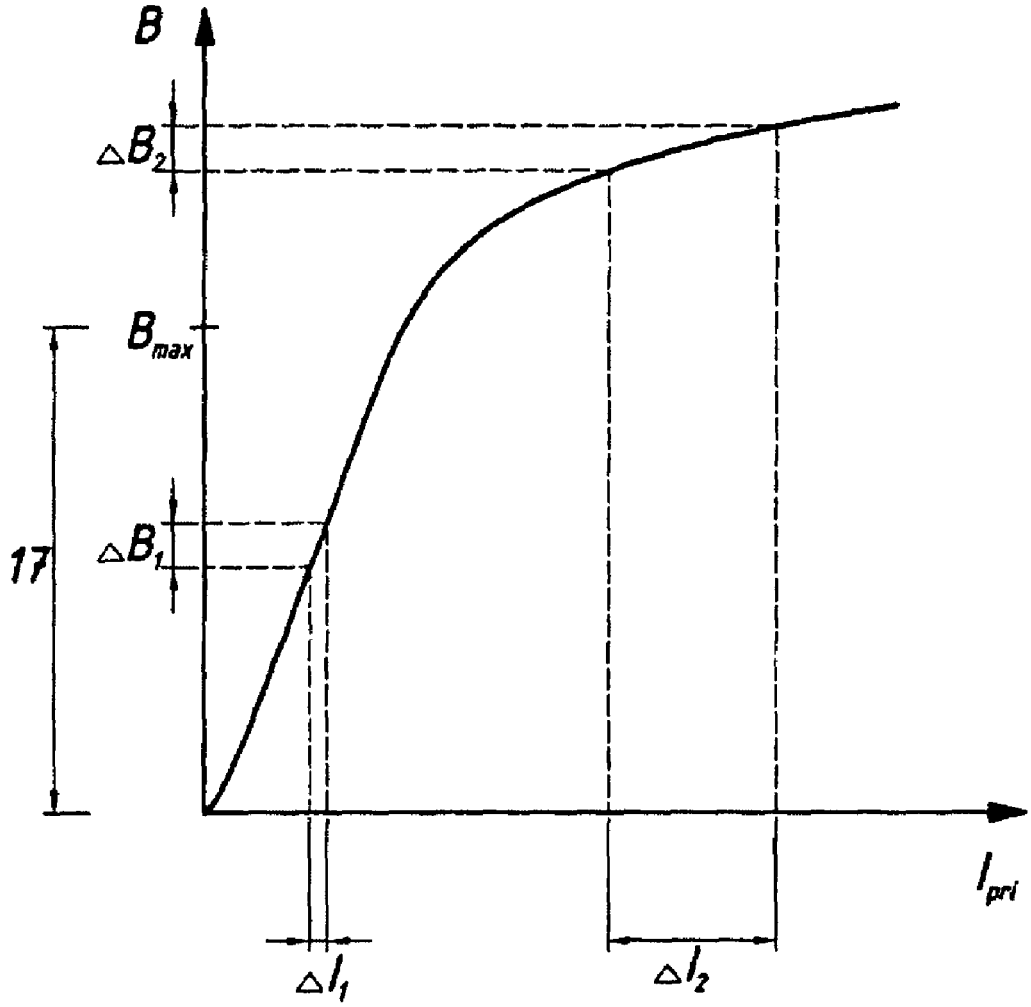
FIG. 3 is a schematic representation of the relationship between primary current and magnetic induction on the primary side of the ignition coil.

Because of the relationship described and represented in FIG. 3 it is therefore advisable to keep the magnitude of the magnetic induction B on the primary side 15 of the ignition coil 12 in the operating range 17. FIG. 3 shows that the magnetism level or the magnetic induction B is a projection of the level of the primary-side current $I_{pri}$. The higher the magnetism level or the magnitude of the magnetic induction B, the higher is also the primary-side current $I_{pri}$ through the ignition coil 3 and the switch 4. A limiting of the magnitude of the magnetic induction B thus also prevents a destruction of the primary-side components by-too high current intensities. It is therefore preferably provided that when the maximum value $B_{max}$ is exceeded the ignition coil 3 is de-energized in order to reduce the magnetism level or the magnitude of the magnetic induction B.

The magnetism level can be determined via the assessment of the activated and de-activated times of the switch 3. In this variant it is thus provided that the control device 12 determines the magnitude of the magnetic induction B on the primary side 15 of the ignition coil 3 indirectly via an assessment of a duration of activated time(s) and de-activated time(s), wherein during the activated time(s) the voltage of the voltage source is applied to the primary side 15 of the ignition coil 3 and during the de-activated time(s) the voltage of the voltage source is not applied to the primary side 15 of the ignition coil 3. An advisable variant provides that the maximum value is a predeterminable period of time and the control device compares this period of time with the total of the activated times, preferably from the beginning of an ignition process, less the total of the de-activated times, preferably from the beginning of the ignition process.

As an alternative to the assessment of the activated and de-activated times it can however also be provided that the ignition device has a primary current measuring device 14 and the control device 12 determines the magnitude of the magnetic induction B on the primary side 15 of the ignition coil 3 indirectly via an assessment of the primary-side current $I_{pri}$. The maximum value $B_{max}$ is here substituted by a predeterminable maximum current value, wherein the control device 12 compares the latter with the magnitude of the primary-side current $I_{pri}$.

Both when assessing the activation and de-activation times and when assessing the primary-side current, indirect procedures are thus employed in order to monitor the magnitude of the magnetic induction B on the primary side 15 of the ignition coil 12. In other variants, however, it is also possible to determine the magnitude of the magnetic induction B directly or indirectly via other known methods.

If the ascertained value of the magnetism level or of the magnitude of the magnetic induction B is too high, the primary-side voltage supply is de-activated by opening the switch 4 until the magnetism level has fallen to an acceptable value. It can be provided here that, subsequent to an interruption or a reduction of the voltage impressed on the primary side 15 of the ignition coil 12, the control device 12 allows or initiates a re-activation or, respectively, an increase of the voltage only when the magnitude of the magnetic induction B on the primary side 15 of the ignition coil 12 falls below the predeterminable maximum value $B_{max}$ or corresponding maximum values of the above-named substitute parameters or a predeterminable re-activation target value. The chosen re-activation target value can thus for example also be lower than the maximum value used for the assessment for each embodiment variant.

During the de-energizing time the polarity of the secondary-side current $I_{sek}$ is observed. If the polarity becomes negative, the ignition spark has gone out and must be restored. It is advantageously provided that the control device 12, subsequent to an interruption or reduction of the voltage impressed on the primary side 15 of the ignition coil 12 will allow a re-activation or, respectively, increase of the primary-side voltage only when a polarity of the secondary-side current $I_{sek}$ changes. In FIG. 2, through the exemplary course of the secondary-side current $I_{sek}$ a phase of the de-energizing Ph3 is drawn in which the secondary-side current initially drops sharply, whereupon the polarity of the secondary-side current becomes negative and then at the time $t_n$ returns to the positive range during a zero-crossing. The course of the primary-side current $I_{pri}$ is represented as the bottom graph. This shows the generally increasing trend of the primary-side current, while in the phase of de-energizing Ph3 a drop in the primary-side current $I_{pri}$ can be seen.

If the ignition spark goes out during the required combustion time, it must be restored as quickly as possible. This may require a voltage which is close to the high voltage supply to the system. In order to satisfy this requirement the energy conditions in the system should be taken into account. For this purpose it can be provided that, subsequent to an interruption of the primary-side voltage and/or current supply of the ignition coil 3 during an ignition process or subsequent to the drop of the primary-side voltage and/or of the primary-side current $I_{pri}$ through the ignition coil 3 below a predeterminable threshold value during the ignition process the control device 12 re-activates the primary-side voltage and/or current supply of the ignition coil 3 or adjusts it/them above the threshold value only when the secondary-side current $I_{sek}$ induced thereby acts in the direction of the, preferably immediately, previously determined course of the secondary-side current. The switch 4 should therefore not be activated if the secondary current $I_{sek}$ is negative. An activation advantageously occurs only at or after the time $t_n$, at which the polarity of the secondary-side changes in current and thus the current induced on the secondary side by the activation of the primary-side voltage supply acts in the direction of the previously determined course of the secondary-side current $I_{sek}$. The start of the ionization phase Ph1 which now follows or of the activation time interval $\Delta t_{an2}$ is thus synchronized with the secondary-side course of the current. In the ionization phase, which now follows, the switch 4 remains closed until the desired high-voltage supply is achieved. Conditions similar to the first activation time interval $\Delta t_{an1}$ prevail if the secondary current $U_{sek}$ passes from the positive half-wave through the zero-crossing. The start time $t_n$ of the ionization phase is determined from the monitoring of the polarity of the secondary-side current $I_{sek}$ (see also FB2 from FIG. 2). Since the eigen-frequency of the ignition device is determined by its components, this is known. Advantageously it can therefore be provided that the control device 12 re-activates the primary-side voltage and/or current supply of the ignition coil 3 or adjusts it/them above the previously determined threshold value, preferably immediately, after a predeterminable time delay subsequent to a change in polarity or zero-crossing of the secondary-side current $I_{sek}$, wherein the predeterminable time delay preferably essentially corresponds to a quarter of the eigen-period, preferably of the secondary side 16, of the ignition device. The ionization phase thus begins with a delay of a quarter of the eigen-period of the system, after the secondary current $I_{sek}$ enters the positive range.

In a preferred embodiment, the ionization phase is prevented from being interrupted by the reaching of the maximum value of the magnitude of the magnetic induction B. It is provided that the ionization phase can be started only when the magnetization level or the magnitude of the magnetic induction B on the primary side 15 of the ignition coil is small enough at the beginning. If this is not the case the system must be de-energized (phase Ph3) until the required low magnetization level is reached. The ionization phase for restoring the ignition spark can thus preferably be started only when the magnetization level and the synchronization condition in the oscillating circuit are met.

In addition, further monitorings of the system for negative impairments or instances of destruction can be provided. In order not to overload the voltage supply, the activated times of the switch 4 during the preset combustion time are added up. If the added-up activated time of the switch 4 exceeds a preset limit value, the ignition process is stopped. This monitoring advantageously takes place regardless of the magnetization level.

The quality of the ignition process is generally judged by the actual combustion time of the ignition spark. The combustion time is measured between the reaching of the preset combustion current target value $I_{rated}$ and the zero value of the secondary current $I_{sek}$. If the ignition spark has gone out during the preset burning period and if this is restored, the measurement is started again with the reaching of the preset current target value and stopped again at the zero value of the secondary current $I_{sek}$. The measured values of the individual measurement processes are added up. Once the ignition process is complete, the combustion time measurement is stopped and the measured value is evaluated. In order to measure or detect spark failures the combustion time measurement is reset if the measurement between the reaching of the combustion current target value and the zero value of the secondary-side current $I_{sek}$ is shorter than the ionization phase. In this case no ignition spark has formed in the first ionization phase. This situation is rated a fault or a failure.

Due to hardware problems a capacitive current can build up in the secondary-side circuit through the capacitive loading of the high-voltage cabling and of the spark plug. This current flows regardless of whether an ignition spark forms or not on the spark plug 5. In order to recognize this, the combustion current target value $I_{rated}$ in the ionization phase is chosen such that the value must be exceeded with certainty. The reaching of the combustion current target value is checked shortly before the end of the ionization phase. If the secondary current $I_{sek}$ is not high enough at this time, there is a hardware fault in the system.

The invention claimed is:

1. A high voltage capacitor discharge ignition device for an internal combustion engine comprising:

a control device;

a voltage supply unit;

an ignition coil which is feedable on a primary side by the voltage supply unit;

a capacitor connected in parallel to the voltage supply unit; and a secondary current measuring device for measuring of the secondary side current the secondary current measuring device being connected to the control device and arranged on a secondary side of the ignition coil wherein the control device is provided to interrupt or reduce the voltage impressed on the primary side of the ignition coil when a magnitude of a magnetic induction B on the primary side of the ignition coil is greater than a predeterminable maximum value and when the secondary current measured by the secondary current measuring device reaches a set value.

2. The high voltage capacitor discharge ignition device according to claim 1, wherein the predeterminable maximum value of the magnitude of the magnetic induction is a maximum limit of an operating range in which there is an at least approximately linear interrelationship between the magnitude of the magnetic induction and a primary side current.

3. The high voltage capacitor discharge ignition device according to claim 1, wherein the predeterminable maximum value of the magnitude of the magnetic induction is below the saturated range of the ignition coil.

4. The high voltage capacitor discharge ignition device according to claim 1, wherein the control device indirectly determines the magnitude of the magnetic induction on the primary side of the ignition coil via an evaluation of a duration of activated time(s) and deactivated time(s), wherein during activated time(s) the voltage of the voltage supply unit is impressed on the primary side of the ignition coil and during deactivated time(s) the voltage of the voltage supply unit is not impressed on the primary side of the ignition coil.

5. The high voltage capacitor discharge ignition device according to claim 4, wherein the maximum value is a predeterminable time span and said control device compares said time span to the total of activated times less the total of deactivated times.

6. The high voltage capacitor discharge ignition device according to claim 5, wherein said control device compares said time span to the total of activated times from the beginning of the ignition process, less the total of deactivated times from the beginning of the ignition process.

7. The high voltage capacitor discharge ignition device according to claim 1, wherein the ignition device comprises a primary current measuring device and the control device indirectly determines the magnitude of the magnetic induction on the primary side of the ignition coil via an evaluation of the primary side current.

8. The high voltage capacitor discharge ignition device according to claim 7, wherein the maximum value is a predeterminable maximum current value and the control device compares this to the value of the primary side current.

9. The high voltage capacitor discharge ignition device according to claim 1, wherein subsequent to an interruption or reduction of the voltage impressed on the primary side of the ignition coil the control device admits or initiates a re-activation or, respectively, an increase of the voltage only when the value of the magnetic induction on the primary side of the ignition coil falls below the predeterminable maximum value or a predeterminable re-activation target value.

10. The high voltage capacitor discharge ignition device according to claim 1, wherein said secondary current measuring device is provided for measuring the course of the secondary side current.

11. The high voltage capacitor discharge ignition device according to claim 9, wherein subsequent to an interruption or reduction of the voltage impressed on the primary side of the ignition coil the control device admits a re-activation or, respectively, an increase of the primary side voltage only when a polarity of the secondary side current changes.

12. The high voltage capacitor discharge ignition device according to claim 1, wherein the control device regulates the primary side voltage or the primary side current at least temporarily in dependence on a course of the secondary side current measured by the secondary current measuring device arranged on the secondary side of the ignition coil.

13. The high voltage capacitor discharge ignition device according to claim 1, wherein the control device regulates the primary side voltage and the primary side current at least temporarily in dependence on a course of the secondary side current measured by the secondary current measuring device arranged on the secondary side of the ignition coil.

14. The high voltage capacitor discharge ignition device according to claim 12, wherein subsequent to an interruption of the primary side voltage or current supply of the ignition coil during an ignition process or subsequent to the drop of the primary side voltage or the primary side current in the ignition coil below a predeterminable threshold during the ignition process, the control device energizes or regulates the primary side voltage or current supply of the ignition coil above the predeterminable threshold only when the secondary side current induced thereby acts in the direction of the predetermined course of the secondary side current.

15. The high voltage capacitor discharge ignition device according to claim 13, wherein subsequent to an interruption of the primary side voltage and current supply of the ignition coil during an ignition process or subsequent to the drop of the primary side voltage and the primary side current in the ignition coil below a predeterminable threshold during the ignition process, the control device energizes or regulates the primary side voltage and current supply of the ignition coil above the predeterminable threshold only when the secondary side current induced thereby acts in the direction of the predetermined course of the secondary side current.

16. The high voltage capacitor discharge ignition device according to claim 12, wherein subsequent to an interruption of the primary side voltage or current supply of the ignition coil during an ignition process or subsequent to the drop of the primary side voltage and/or the primary side current in the ignition coil below a predeterminable threshold during the ignition process, the control device energizes or regulates the primary side voltage or current supply of the ignition coil above the predeterminable threshold only when the secondary side current induced thereby acts in the direction of the instantaneously predetermined course of the secondary side current.

17. The high voltage capacitor discharge ignition device according to claim 13, wherein subsequent to an interruption of the primary side voltage and current supply of the ignition coil during an ignition process or subsequent to the drop of the primary side voltage and/or the primary side current in the ignition coil below a predeterminable threshold during the ignition process, the control device energizes or regulates the primary side voltage and current supply of the ignition coil above the predeterminable threshold only when the secondary side current induced thereby acts in the direction of the instantaneously predetermined course of the secondary side current.

18. The high voltage capacitor discharge ignition device according to claim 14, wherein the control device energizes or regulates the primary side voltage or current supply of the ignition coil above the predeterminable threshold after a change in polarity or, respectively, a zero-crossing of the secondary side current.

19. The high voltage capacitor discharge ignition device according to claim 15, wherein the control device energizes or regulates the primary side voltage and current supply of the ignition coil above the predeterminable threshold after a change in polarity or, respectively, a zero-crossing of the secondary side current.

20. The high voltage capacitor discharge ignition device according to claim 18, wherein the control device energizes or regulates the primary side voltage or current supply of the ignition coil above the predeterminable level after a presettable delay of time subsequent to a change in polarity or, respectively, a zero-crossing of the secondary side current.

21. The high voltage capacitor discharge ignition device according to claim 19, wherein the control device energizes or regulates the primary side voltage and current supply of the ignition coil above the predeterminable level after a presettable delay of time subsequent to a change in polarity or, respectively, a zero-crossing of the secondary side current.

22. The high voltage capacitor discharge ignition device according to claim 18, wherein the control device energizes or regulates the primary side voltage or current supply of the ignition coil above the predeterminable level instantaneously after a presettable delay of time subsequent to a change in polarity or, respectively, a zero-crossing of the secondary side current.

23. The high voltage capacitor discharge ignition device according to claim 19, wherein the control device energizes or regulates the primary side voltage and current supply of the ignition coil above the predeterminable level instantaneously after a presettable delay of time subsequent to a change in polarity or, respectively, a zero-crossing of the secondary side current.

24. The high voltage capacitor discharge ignition device according to claim 20, wherein the presettable delay of time essentially corresponds to a quarter of the eigen-period of the secondary side of the ignition device.

25. The high voltage capacitor discharge ignition device according to claim 14, wherein, on activation of the ignition device at the beginning of an ignition process or subsequent to an interruption of the primary side voltage or current supply of the ignition coil or subsequent to a drop of the primary side voltage or of the primary side current in the ignition coil below a predeterminable level during an ignition process, the control device provides an activation time interval during which the voltage of the voltage supply unit is permanently impressed on the primary side of the ignition coil in full intensity or for a predeterminable time span.

26. The high voltage capacitor discharge ignition device according to claim 15, wherein, on activation of the ignition device at the beginning of an ignition process and subsequent to an interruption of the primary side voltage and current supply of the ignition coil or subsequent to a drop of the primary side voltage and of the primary side current in the ignition coil below a predeterminable level during an ignition process, the control device provides an activation time interval during which the voltage of the voltage supply unit is permanently impressed on the primary side of the ignition coil in full intensity and for a predeterminable time span.

27. The high voltage capacitor discharge ignition device according to claim 25, wherein during the activation time interval the control device monitors the secondary side current via the secondary current measuring device or a secondary side voltage emitted by the ignition coil via a secondary voltage measuring device and interrupts the primary side voltage supply of the ignition coil when the secondary side current or the secondary side voltage emitted by the ignition coil exceeds (a) predeterminable limit value(s).

28. The high voltage capacitor discharge ignition device according to claim 26, wherein during the activation time interval the control device monitors the secondary side current via the secondary current measuring device and a secondary side voltage emitted by the ignition coil via a secondary voltage measuring device and interrupts the primary side voltage supply of the ignition coil when the secondary side current and the secondary side voltage emitted by the ignition coil exceeds (a) predeterminable limit value(s).

29. The high voltage capacitor discharge ignition device according to claim 25, wherein the control device regulates the primary side voltage or the primary side current in dependence on the course of the secondary side current only subsequently to the activation time interval.

30. The high voltage capacitor discharge ignition device according to claim 26, wherein the control device regulates the primary side voltage and the primary side current in dependence on the course of the secondary side current only subsequently to the activation time interval.

31. The high voltage capacitor discharge ignition device according to claim 1, wherein the voltage supply unit comprises at least one direct current supply unit and at least one capacitor which is in parallel connection thereto.

32. The high voltage capacitor discharge ignition device according to claim 31, wherein said direct current supply unit is a DC-DC-converter.

33. The high voltage capacitor discharge ignition device according to claim 1, wherein a switch triggered by the control device is provided on the primary side of the ignition coil, the switch having at least one first status in which the voltage of the voltage supply unit is impressed on the ignition coil and at least a second status in which the voltage of the voltage supply unit is not impressed on the ignition coil.

34. The high voltage capacitor discharge ignition device according to claim 1, wherein, by means of the secondary current measuring device, the control device analyses the course of the secondary side current with regard to its polarity or its magnitude.

35. The high voltage capacitor discharge ignition device according to claim 1, wherein, by means of the secondary current measuring device, the control device analyses the course of the secondary side current with regard to its polarity and its magnitude.

36. The high voltage capacitor discharge ignition device according to claim 1, wherein, by means of the secondary current measuring device, the control device analyses whether the magnitude of the secondary side current is greater than or equal to a predeterminable minimum value or not.

37. The high voltage capacitor discharge ignition device according to claim 1, wherein said internal combustion engine is a gas engine.

* * * * *